United States Patent [19]

Glenn

[11] Patent Number: 4,565,912

[45] Date of Patent: Jan. 21, 1986

[54] TRIGGER SWITCH WITH ROTATING CONTACT CARRIER

[75] Inventor: Robert L. Glenn, Arab, Ala.

[73] Assignee: Eaton Corporation, Cleveland, Ohio

[21] Appl. No.: 610,067

[22] Filed: May 14, 1984

[51] Int. Cl.[4] ..... H01H 21/10; H01H 13/08

[52] U.S. Cl. ..... 200/157; 200/156; 200/252

[58] Field of Search ..... 200/157, 156, 155 R, 200/252, 303, 4, 159 R, 159 A, 336, 164 R

[56] References Cited

U.S. PATENT DOCUMENTS

| | | | |
|---|---|---|---|
| 1,285,072 | 11/1918 | Douglas | 200/156 |
| 2,703,348 | 3/1955 | Knapp et al. | 200/156 |
| 2,974,597 | 3/1961 | Hesson | 200/156 |
| 3,120,585 | 2/1964 | Harris, Jr. et al. | 200/156 X |
| 3,194,898 | 7/1965 | Thomas | 200/4 |
| 3,592,982 | 7/1971 | Deltoer | 200/4 X |
| 3,819,894 | 6/1974 | Flumignan et al. | 200/156 |
| 4,225,758 | 9/1980 | Kondo et al. | 200/4 |
| 4,241,297 | 12/1980 | Piber et al. | 200/157 X |
| 4,241,298 | 12/1980 | Trammell, Jr. et al. | 200/157 X |

*Primary Examiner*—Stephen Marcus
*Assistant Examiner*—Ernest G. Cusick
*Attorney, Agent, or Firm*—C. H. Grace; L. G. Vande Zande

[57] ABSTRACT

A cylindrical contact carrier (4) is journaled for rotational movement about an axis extending in the direction of linear movement of a depressible trigger operator (2). Spiral grooves (**4*d*) formed in the carrier (4) cooperably receive cam elements (10*g*) which are disposed in fixed planes with respect to the axis of rotation and depression of the trigger operator (2) effects relative linear movement of the cam elements (10*g*) with respect to the spiral grooves (4*d*) to cause rotation of the carrier (4) for moving contacts (18) positioned on the carrier (4) into and out of engagement with stationary contacts (22) disposed around the periphery of the carrier (4**).

5 Claims, 3 Drawing Figures

TRIGGER SWITCH WITH ROTATING CONTACT CARRIER

BACKGROUND OF THE INVENTION

This invention relates to trigger operated electric switches adapted for use in hand held portable tools. More particularly, the invention relates to a switch of the aforementioned type wherein the trigger is linearly depressible from an extended position and depression thereof effects rotational movement of a contact carrier member.

In providing switching contact actions for switches of the aforementioned type, it is often difficult in view of the compactness of the switch design to provide adequate electrical clearance between the movable and stationary contacts when the switch is in the off position. It is also desirable to provide significant wiping action of the movable contacts upon the stationary contacts when making and breaking the electrical connections therebetween. The nature of the application or utilization of such switches in portable electric tools dictates that the operator be a depressible member commonly controlled by the forefinger of the hand which holds the tool. In previous switch designs the operator movement has typically provided linear movement for contact actuation.

SUMMARY OF THE INVENTION

The invention described herein provides a trigger operated electric switch which is adapted for use in a hand held portable tool and which comprises a housing having stationary contacts disposed therein, a linearly depressible trigger extending from the housing and biased to an extended position, a contact carrier having movable contacts positioned thereon, the carrier being disposed within the housing and mounted for rotation about an axis extending in the direction of linear depression of the trigger, and drive means responsive to depression of the trigger for effecting rotational movement of the contact carrier to move the movable contacts into bridging engagement with the stationary contacts.

The invention and its advantages will be more readily understood in the following description and claims when read in conjunction with the accompanying drawings.

DESCRIPTION OF THE PREFERRED EMBODIMENT

Figure 2:
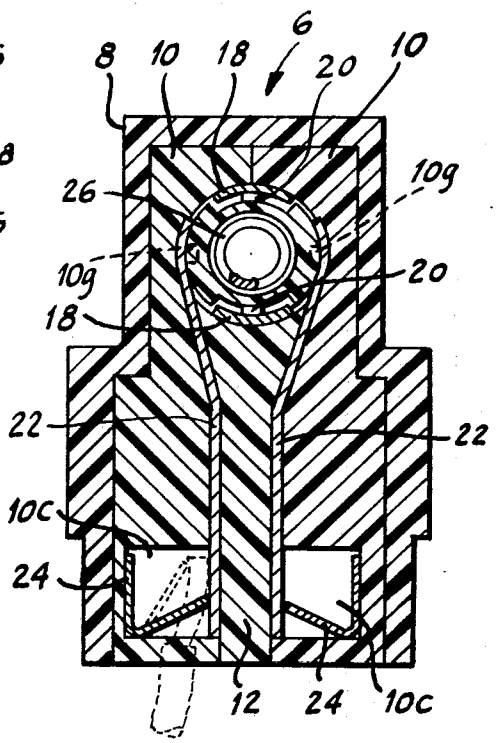
FIG. 2 is a transverse cross sectional view of the switch of this invention taken along the line 2—2 in FIG. 1.
Figure 1:
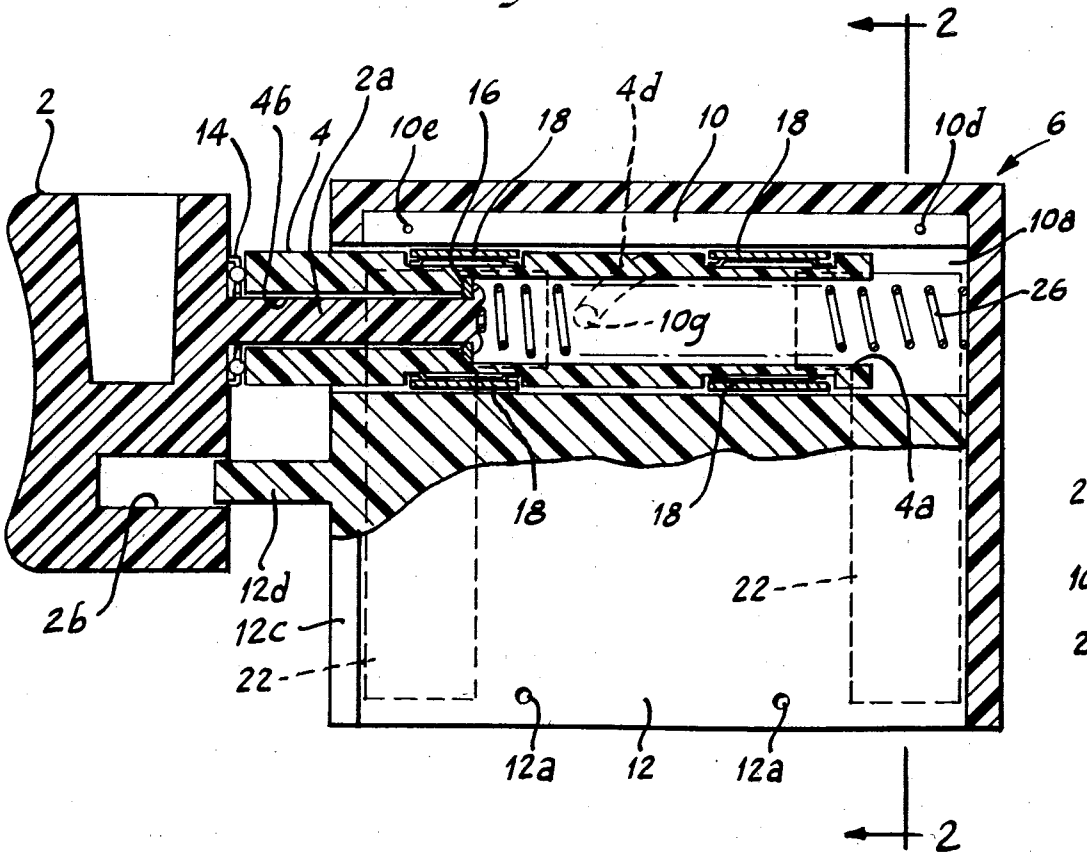
FIG. 1 is a longitudinal cross sectional view of a switch constructed in accordance with this invention.

Referring to the drawings, the switch of this invention comprises a trigger operator 2 having a contact carrier 4 rotatably mounted thereon which is housed within an insulating housing assembly 6 comprising a molded insulating frame 8, a pair of identical mold insulating base halves 10, and an insulating spacer 12. Trigger 2 is molded of insulating material and has a shaft 2*a* extending rearwardly thereof, the outermost end of the shaft 2*a* having a cylindrical recess formed therein.

Immediately below the shaft 2*a* the trigger 2 is provided with a cylindrical recess 2*b*, the axial direction of the recess 2*b* being substantially parallel to the axial direction of the shaft 2*a*. Contact carrier 4 is a cylindrical member having a cylindrical recess 4*a* extending from the right-hand end thereof as viewed in the drawings and a second, reduced diameter cylindrical recess 4*b* therein extending from the left-hand end as viewed in the drawings, the recesses 4*a* and 4*b* communicating to provide a stepped shouldered surface within the carrier 4. The latter is assembled to trigger 2 by positioning the recess 4*b* over the shaft 2*a* of the trigger and turning over the cylindrical outer end portion of shaft 2*a* upon the internal shouldered surface formed by the juncture of recesses 4*a* and 4*b* within the contact carrier 4. Preferably, a bearing member 14 is disposed over shaft 2*a* between the rear face of the trigger 2 and the left-hand end of contact carrier 4 and a flat cylindrical washer 16 is positioned over the shaft 2*a* within the recess 4*a* to be disposed between the shouldered surface of the contact carrier 4 and the turned over end of shaft 2*a*.

Figure 3:
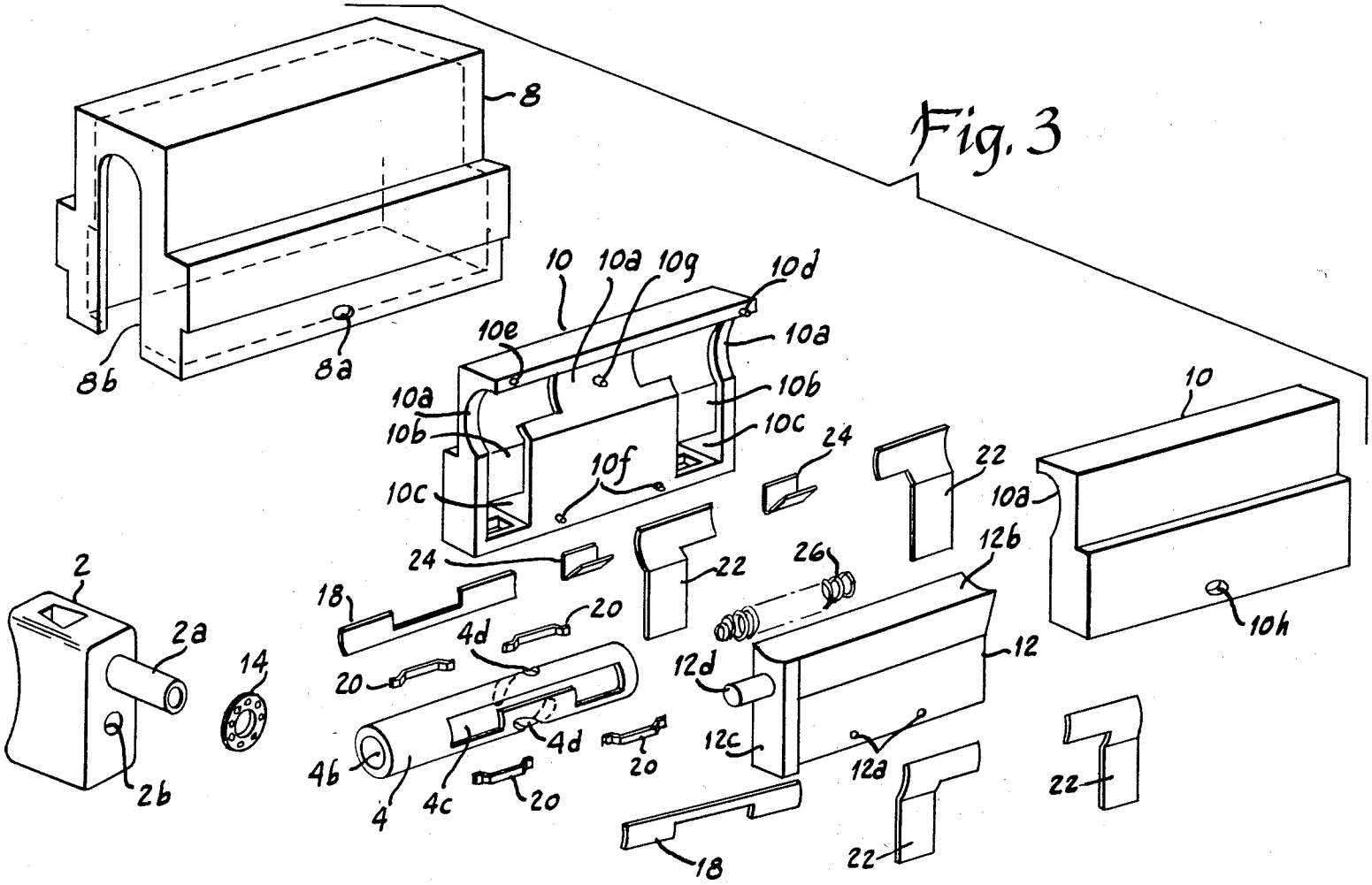
FIG. 3 is an exploded isometric view of the switch of this invention.

The external surface of cylindrical contact carrier 4 is provided with a pair of recesses 4*c* (only one of which is shown in FIG. 3) for receiving movable contact members 18 therein. A pair of leaf springs 20 are disposed within the recess 4*c* under the opposite ends of each movable contact 18. The external surface of contact carrier 4 is also provided with a pair of spiral grooves 4*d* for reasons that will be described hereinafter.

The insulating base halves 10 have a substantially half-cylindrical recess 10*a* formed along their interior surface near the upper edge thereof. The interior surface of each base half is also provided with recessed portions 10*b* which receive complementally formed stationary contacts 22 therein. Pockets 10*c* are formed below each of the recesses 10*b*, the pockets 10*c* having openings through the bottom wall of the base through which electric wires may be inserted to make electric connection to the switch. To this end, each pocket 10*c* receives a V-shaped wire terminal clip 24 which is positioned within the pocket to force a wire conductor against the stationary contact 22 when such conductor is inserted as shown in dotted lines in FIG. 2. Each base half is provided with a projection 10*d* and recess 10*e* along the upper edge thereof for engagement by the respective opposite projection and recess of the other base halve when assembled to thereby aid in positioning the two base halves together. Each base half is also provided with a pair of projections 10*f* near the lower edge thereof which project into openings 12*a* in the insulator 12 to position the insulator with respect to the base halves. A cylindrical projection 10*g* is formed in each base half within the cylindrical recess area 10*a*. The projections 10*g* cooperate with the spiral grooves 4*d* in the contact carrier 4 when the switch is assembled as will be more fully described hereinafter.

The insulating spacer 12 has a cylindrically recessed upper surface 12*b* which is shaped complementally to the cylindrical shape of contact carrier 4. The left-hand end of insulator 12 is provided with a rectangular flange 12*c* which in turn is provided with an outwardly projecting cylindrical boss 12*d*. A helical compression spring 26 is provided to be received within the recess 4*a* of the contact carrier to bear between the projecting end of shaft 2*a* of trigger 2 and an interior end wall of housing frame 8 when the switch is assembled to bias the trigger 2 and contact carrier 4 to an extended position with respect to the housing.

To assemble the switch, the contact clips 24 and stationary contacts 22 are assembled to the respective base halves 10 as aforedescribed. The assembly comprising trigger 2 and contact carrier 4, having movable contacts 18 and their respective leaf springs 20 assembled thereto, is disposed within the cylindrical recessed area 10*a* of one of the base halves such that a respective spiral groove 4*d* is engaged over a projection 10*g*. The insulating spacer 12 is then positioned along the bottom side of the cylindrical contact carrier 4 such that the latter rests within the dished cylindrical surface 12*b* of the spacer, and the projections 10*f* of the base half 10 are received within the recesses 12*a* of the insulating spacer 12. The opposite base half is then assembled over the contact carrier 4, the projections 10*f* of the opposite base half engaging the recesses 12*a* of the insulating spacer and the respective projections 10*d* being received within the respective recesses 10*e* along the upper edge of the two base halves. The spring 26 is inserted within the recess 4*a* open to the right-hand end of the contactor 4. This assembly is then inserted upward through an open bottom of housing 8 to be held together by the housing. Each base half is provided with a projection 10*h* centrally located along an outer surface near the bottom edge thereof for snap fit engagement with corresponding recesses 8*a* in the housing frame 8 to securely lock the assembly together. The frame 8 is also provided with a slot 8*b* along one end thereof open to the bottom edge, the slot receiving the rectangular flange 12*c* of insulating spacer 12. The projection 12*d* of insulating spacer 12 extends partly into the recess 2*b* of trigger 2 to serve as a guide for the trigger to prevent the latter from rotating.

In operation, linear depression of the trigger 2 into the housing 6 effects linear translation of the contact carrier 4. Such movement of the carrier 4 causes respective movement between the spiral grooves 4*d* and the projections 10*g* formed on the base halves 10, this relative movement causing the projections 10*g* to rotate the contact carrier 4 about the axis of shaft 2*a* as the trigger 2 and contact carrier 4 are depressed against the bias of spring 26. The rotational movement of contact carrier 4 carries the movable contact members 18 into engagement with the stationary contact members 22. The operation of trigger 2 and contact carrier 4 cause the movable contacts 18 to engage the stationary contacts 2 with a combined linear and rotary translational wiping action which provides enhanced switching characteristics.

While the switch of this invention has been disclosed in a preferred embodiment, it is to be understood that it is susceptible of various modifications without departing from the scope of the appended claims. For example, base halves 10 and insulating spacer assembly 12 may be secured together by other clamping means or by an adhesive or by sonic welding if desired to thereby eliminate the insulating frame member 8. Moreover, the spiral grooves 4*d* may be formed on an internal surface of the cylindrical contact carrier 4, and the cylindrical contact carrier 4 may be journaled for rotation within the housing 10 without linear translation. In such case, the shaft 2*a* of trigger 2 could be formed with cooperating cam projections whereby depression of the trigger within the contact carrier would effect rotation of the contact carrier without the aforedescribed linear translation thereof.

I claim:

1. A trigger operated electric switch adapted for use in a hand held portable tool comprising, in combination:

a housing;

stationary contacts in said housing;

linearly depressible trigger operating means extending from said housing;

means biasing said trigger operating means to an extended position with respect to said housing;

contact carrier means rotatably mounted on said trigger operating means within said housing for linear movement with said trigger operating means and for rotation about an axis extending in the direction of linear depression of said trigger operating means;

movable contacts carried by said contact carrier means; and means responsive to depression of said trigger operating means for effecting rotation of said contact carrier means to move said movable contacts into bridging engagement with said stationary contacts with a combined linear and rotational wiping action.

2. The invention defined in claim 1 wherein said means for effecting rotation of said contact carrier means comprises spiral groove means formed in said carrier means and drive means disposed in fixed planes received in said groove means, depression of said trigger operating means effecting relative linear movement between said drive means and said contact carrier means.

3. The invention defined in claim 2 wherein said trigger operating means is guided for non-rotatable movement when being depressed.

4. The invention defined in claim 3 wherein said trigger operating means comprises a shaft extending in the direction of linear movement within said housing and said contact carrier means is journaled for rotation on said shaft.

5. The invention defined in claim 4 wherein said contact carrier means comprises a cylindrical sleeve of larger cross-sectional diameter than a cross-sectional diameter of said shaft and being disposed over said shaft.

* * * * *